United States Patent [19]

Berger

[11] 4,395,790

[45] Aug. 2, 1983

[54] SHOE MACHINE

[75] Inventor: Jean-Pierre Berger, Gretz, France

[73] Assignee: USM Corporation, Farmington, Conn.

[21] Appl. No.: 312,255

[22] Filed: Oct. 16, 1981

[30] Foreign Application Priority Data

Oct. 16, 1980 [FR] France ..... 80 22148

[51] Int. Cl.[3] ..... A43D 21/12; A43D 23/00

[52] U.S. Cl. ..... 12/8.1; 12/12

[58] Field of Search ..... 12/8.1, 8.2, 12, 14.3

[56] References Cited

U.S. PATENT DOCUMENTS 2,655,672 10/1953 Courchene ..... 12/8.1

3,995,340 12/1976 Becker ..... 12/8.1

4,167,052 9/1979 Schindler ..... 12/8.1

*Primary Examiner*—Patrick D. Lawson

*Attorney, Agent, or Firm*—Donald N. Halgren

[57] ABSTRACT

A side lasting machine having a last support, for supporting a last bottom uppermost, and two side lasting assemblies, arranged one at each side of the last support, each assembly comprising a plurality of lasting elements (fingers), a plurality of clamp pads arranged beneath the fingers, and depending from each finger and interposed between the pads and the upper, a plurality of lasting bands. In operation, the pads hold the bands against the upper under a pressure sufficient to allow slipping between the bands and the pads, while causing the bands to apply a drafting force to the upper. As the fingers move inwardly, they draw the bands upwards so that the upper is updrafted before the lasting margin is secured to the insole. The fingers, in the rest condition, are spaced above the level of the last bottom and move downwardly thereonto as they are moved inwardly, thus avoiding the need to set their heightwise position for different styles of shoe.

10 Claims, 2 Drawing Figures

SHOE MACHINE

BACKGROUND OF THE INVENTION (1) Field of the Invention

This invention is concerned with a shoe upper conforming machine for use in lasting side portions of shoe uppers. The term "shoe" where used herein is used generically as indicating articles of outer footwear generally, including such articles in the course of manufacture.

(2) Prior Art

Shoe upper conforming machines for use in lasting side portions of shoe uppers are known comprising a support for a shoe last on which an upper, the side portions of which are to be lasted, and an insole are positioned, and two side lasting assemblies arranged so as to act on opposite side portions of an upper positioned on a last supported by said support. Each side lasting assembly comprises clamping means, comprising at least one clamp member, movable towards the last support to cause a side portion of the upper to be held against the last, on which it is positioned and which is supported by the last support, at a locality spaced from the feather line thereof, lasting element means, comprising a plurality of lasting elements arranged side-by-side and movable inwardly towards the last support so as to cause lasting marginal portions of the side portion of the upper to be wiped over corresponding marginal portions of the insole and be pressed thereagainst, and lasting band means comprising at least one upper-engaging band portion of flexible sheet material arranged to be interposed between the shoe upper on the one hand and the lasting elements and the clamp member(s) on the other.

One such machine is described in U.K. Patent Application No. 76.28027, in which machine each side lasting assembly comprises a single lasting band which is supported at its upper and lower edges, the arrangement being such that, as the lasting band is moved inwardly towards the last support, a portion thereof intermediate its upper and lower edges first engages the upper in the waist region, continued movement thereafter causing the upper to be deformed in the direction of both the top line and the feather line. The inward movement of each assembly, furthermore, is limited by a presser pad between which the upper and the lasting band is interposed, which pad also assists in holding the upper in position against the last during the lasting operation. When the inward movement of each lasting band is arrested, the lasting marginal portions of the upper, which are already partially folded over the feather line by the action of the inward movement of the lasting band, is merely rolled over and pressed against corresponding marginal portions of the insole by presser feet, which also serve to support one edge of the lasting band.

It will thus be appreciated that, in the operation of this machine, no significant drafting of the upper, in the waist portion thereof, takes place but rather the upper is deformed to the shape of the last by the progressive application of pressure thereto from an intermediate point outwardly towards the top line and feather line. Furthermore, the action of the presser feet is merely to roll the lasting marginal portion of the upper over the insole edge without any inward wiping action being applied thereto.

In U.S. Pat. No. 1,722,499 there is described a machine having side lasting assemblies, each of which comprises a plurality of lasting devices, each device in turn comprising a lasting element in the form of a wiping finger, a strap of flexible material one end of which is secured to the wiping finger, and the other end also being secured to a portion of the assembly, and a clamp pad between which the upper and the strap are interposed. In the operation of this machine, each device operates independently of the others, the arrangement being such that each assembly is moved bodily towards the shoe and the presser pads are brought into pressing engagement with the band against the upper, thus to clamp the upper against the last at a locality closely adjacent the feather line. Thereafter, the pressure applied by the pads is increased as the wipers move inwardly to wipe lasting marginal portions of the upper against corresponding marginal portions of the insole and press them thereagainst. Thereafter, the wiping fingers are cammed down from an out-of-the-way position to lay the lasting marginal portions of the insole and press them thereagainst.

A further modification of this machine is described in U.S. Pat. No. 1,843,232. In this machine, the straps are secured to the clamp members at one end and are resiliently connected at the other to the wiping fingers, the arrangement being such that the wiping fingers effect an in-wiping action effectively on the strap rather than on the upper, the resilient connection yielding during such in-wiping movement so that the wiping fingers move relative to their associated straps. The overall effect of this arrangement is that the lasting marginal portions of the upper are again merely laid over corresponding marginal portions of the insole and pressed thereagainst.

In French Patent Specification No. 1,396,694 are described two lasting machines, in a first of which two side lasting assemblies are provided, each comprising a plurality of lasting bands which are pressed against the upper by clamp members in the form of fingers, the bands being capable of limited movement heightwise of the last thus to provide an updraft on the upper prior to lasting marginal portions thereof being folded over the insole edge and pressed against corresponding marginal portions of the insole. In this machine, however, no separate lasting elements are provided, the bands serving the function of both updrafting and overlaying members. Again, in French Specification No. 71.14812, a machine is described having two side lasting assemblies, each comprising a plurality of lasting elements and a plurality of bands, but in this case no clamping pads are provided, the upper merely being engaged by the bands which are drawn over insole edge, together with lasting marginal portions of the upper, during the in-wiping movement of the lasting elements.

In the side lasting of shoes, problems arise where the inside of the last, at the waist region, is significantly inclined or rounded, so that it is difficult to ensure that the material of the upper, which is relatively bulky, is properly bedded down to the last before the lasting marginal portions of the upper are secured to corresponding marginal portions of the insole. Thus, it is not always sufficient merely to rely on the in-wiping action of wiping fingers to ensure that the upper is properly bedded to the last, nor is it necessarily sufficient merely to press the upper against the last without any drafting force being first applied. On the other hand, the use of wiping fingers or similar lasting elements is advantageous in ensuring a sharp feather on the finished shoe and also an adequate bedding down of the lasting marginal portions on to corresponding marginal portions of the insole, so that the mere application of an updrafting force does not in itself necessarily provide a good result in the finished shoe. Furthermore, it is desirable that clamp pads be provided so that a controlled drafting force can be applied to the upper, thus ensuring that any displacement of the upper does not lead to its being badly positioned on the last prior to the waist lasting operation.

It is thus the object of the present invention to provide a side lasting machine in which the upper is properly conformed to the last, regardless of the shape of the latter in the waist region, by the application of a controlled drafting force, and also in the operation of which lasting marginal portions of the upper are wiped over corresponding marginal portions of the insole and pressed thereagainst using conventional lasting elements.

BRIEF SUMMARY OF THE INVENTION

The invention thus provides a shoe machine for use in lasting side portions of shoe uppers comprising a support for a shoe last on which an upper, the side portions of which are to be lasted, and an insole are positioned, and two side lasting assemblies arranged so as to act on opposite side portions of an upper positioned on a last supported by said support, wherein each side lasting assembly comprises clamping means, comprising at least one clamp member, movable towards the last support to cause a side portion of the upper to be held against the last on which it is positioned and which is supported by the last support, at a locality spaced from the feather line thereof. Lasting element means, comprising a plurality of lasting elements arranged side-by-side and movable inwardly towards the last support so as to cause lasting marginal portions of the side portion of the upper to be wiped over corresponding marginal portions of the insole and be pressed thereagainst, and lasting band means comprising at least one upper-engaging band portion of flexible sheet material arranged to be interposed between the shoe upper on the one hand and the lasting elements and the clamp member(s) on the other, are characterized in that the or each upper-engaging band portion is held by the clamp member(s), in the operation of the machine, against the upper positioned on its last under a pressure which does not prevent movement of the upper-engaging band portion(s) relative to the clamp member(s) but which is suffient to cause such movement of said portion(s) to apply a drafting force to the portion of the upper engaged thereby, and inward movement of the lasting elements towards the last support as aforesaid is effective to cause movement of said portion(s) to take place relative to the clamp member(s) whereby, in the operation of the machine, a drafting force is applied to the upper by said portion(s) heightwise of the last in the direction of the feather line of the shoe.

It will thus be appreciated that, using a machine in accordance with the invention, the lasting elements are utilized to apply a controlled drafting force to the upper through the upper-engaging band portion(s), the control being specifically achieved by the action of the clamp member(s) acting on the band portion(s).

Desirably, the upper-engaging surface of the or each upper-engaging band portion is such as to cause the upper to be frictionally engaged thereby, thus to apply a drafting force to the upper as aforesaid and at least one of the opposite surface of the or each band portion and the surface of the or each clamp member engaging such opposite surface is a low-friction surface. Thus, for example, the aforementioned surface of the or each clamp member may be of polytetrafluoroethylene, or again the or each upper-engaging band portion may be made of a laminated sheet material having a first layer which comprises the upper-engaging surface and which provides sufficient friction to apply a drafting force to the upper engaged thereby, and a second layer which comprises a low-friction surface which is engaged by the clamping member(s).

In order further to ensure that the drafting force applied by the band portion(s) is controlled, desirably the sheet material from which the or each portion is made has a modulus not less than 850 p.s.i. at 100% elongation (as per the ASTM test procedure).

The or each upper-engaging band portion is preferably connected to the lasting element means. Furthermore, where the last support is arranged to support a last bottom up, the or each band portion may merely hang down from the lasting element means without support at its opposite end. Preferably, however, resilient means acts on the other end thereof, applying sufficiently light tension to maintain the or each band portion taut in the rest condition of the machine, while allowing the or each portion to be moved relative to the clamp member(s) as aforesaid in the operation of the machine. Conveniently, said other end of the or each upper-engaging band portion is connected by resilient means to mounting means for the clamping member(s).

The holding pressure applied by the clamp member(s) to the upper-engaging clamp portion(s) is preferably of the order of 1.4 kgf/sq. cm. (20 lbs/sq. in.). To this end, preferably fluid pressure operated means is provided for effecting movement of the clamp member(s) towards the last support as aforesaid. In addition, preferably locking means is provided, e.g. a bar lock arrangement associated with the or each clamp member, whereby in the operation of the machine, after the or each clamp member has been moved towards the last support to hold the upper-engaging band portion(s) as aforesaid, the or each clamp member is locked in such position.

The machine in accordance with the invention is preferably constructed and arranged in such a manner that operation of the fluid pressure operated means is also effective to cause inward movement of the lasting elements to take place, further fluid pressure operated means also being provided for effecting further inward movement of the lasting elements, when the or each clamp member is holding the upper-engaging band portion(s) against the upper as aforesaid. Conveniently, such further inward movement of the lasting elements is through a predetermined distance. Furthermore, conveniently in the operation of the machine, after lasting marginal portions of the upper have been wiped over corresponding marginal portions of the insole as aforesaid under the action of the lasting element means, said locking means is caused to release the clamp member(s) of each side lasting assembly, and bedding pressure is applied through the lasting elements to such marginal portions. To this end, conveniently a linkage arrangement interconnects the clamp member(s) and lasting elements, through which arrangement said further fluid pressure operated means is effective, upon release of the locking means, to cause the clamp member(s) to be withdrawn so as to no longer hold the band portion(s)

against the upper during the application of bedding pressure.

In conventional machines which utilize lasting elements in the form of wiping fingers, it is usual to set each lasting element lengthwise of the last support, so that, in effecting an in-wiping action on the shoe bottom, each such element engages the shoe just below the feather line and rides up over said line, in this way achieving a desired in-wiping drafting force. This feature can be dispensed with in the machine in accordance with the invention, and to this end preferably each lasting element is movable not only inwardly towards the last support as aforesaid, but also heightwise thereof between a first condition, in which a pressure-applying surface thereof is spaced from the shoe bottom, and a second condition, in which, in the operation of the machine, said element is in pressing engagement with the shoe bottom, the arrangement being such that, as each element is moved inwardly towards the last support as aforesaid, it is also moved from its first to its second condition, whereby the or each band portion is caused to be drawn around the feather edge of the shoe bottom, thus effecting a drafting force on the upper prior to the lasting marginal portions of the upper engaged thereby being pressed against corresponding marginal portions of the insole. Furthermore, each lasting element is preferably also mounted for pivotal movement, about an axis extending lengthwise of the shoe bottom, on a mounting (forming part of the lasting element means) which is movable heightwise of the last support, such heightwise movement being effective to cause the element to be moved between its first and second conditions as aforesaid, and resilient means being provided for urging the element about said axis to a position in which a trailing portion of the pressure-applying surface thereof is inclined towards the clamp member(s), the arrangement being such that when, in the operation of the machine, inward movement of the lasting elements is effected, such trailing portions are caused to press the band portion(s) against the upper and are thereupon pivoted, against the action of the resilient means, to a position in which such surface is in pressing engagement with the band portion(s). In this way, as the lasting elements move inwardly, they effect an "ironing" action on the wiped-over lasting marginal portions of the upper.

Whereas it is considered that in accordance with the invention a single lasting band portion may be used in combination with a plurality of lasting elements in a preferred embodiment of machine in accordance with the invention, the lasting band means of each side lasting assembly comprises a plurality of band portions, one associated with each lasting element, and furthermore the lasting elements are mounted in pairs and each pair has one clamp member assocated therewith, each clamp member thus being arranged to hold two band portions in pressing engagement with the upper as aforesaid.

BRIEF DESCRIPTION OF THE DRAWINGS

There now follows a detailed description, to be read with reference to the accompanying drawings, of one machine in accordance with the invention, this machine having been selected for description merely by way of exemplification of the invention and not by way of limitation thereof.

In the accompanying drawings.

DESCRIPTION OF THE PREFERRED EMBODIMENTS

Figure 1:
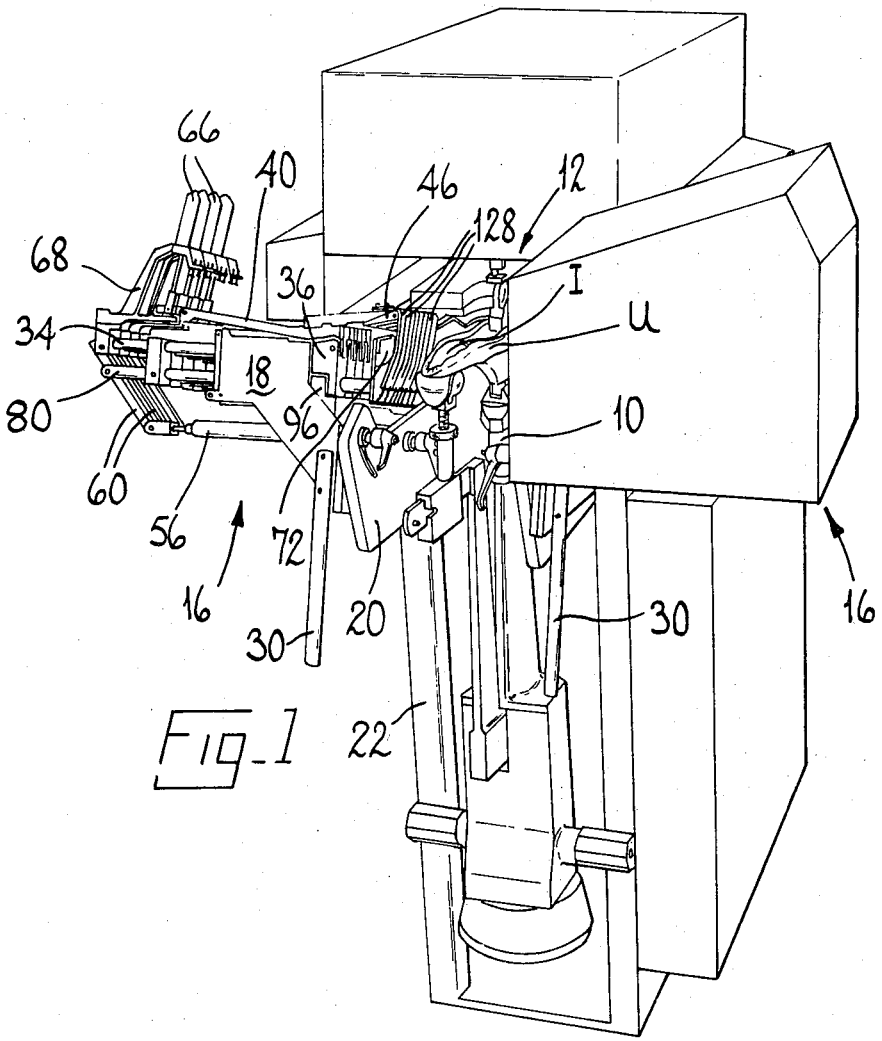
FIG. 1 is a front perspective view of the machine in accordance with the invention.

The shoe machine now to be described is a combined heel seat and side lasting machine comprising a last support 10 on which a last can be supported, bottom uppermost, with an insole I located on the bottom thereof and a shoe upper U positioned thereon, as shown in FIG. 1. The machine further comprises heel seat wiping instrumentalities 12 and a heel band 14, shown in FIG. 2, and also two side lasting assemblies generally designated 16, arranged forwardly of the heel seat lasting instrumentalities, one at either side of the last support 10. The side lasting assemblies are mirror-opposites of one another and the left hand assembly will be now described with reference to FIG. 2.

The side lasting assembly 16 comprises a sub-frame 18 carried on a forwardly extending plate 20 mounted on a main machine frame 22 by pin-and-slot connections whereby the side lasting assembly 16 can pivot bodily about an axis extending transversely of the machine through a leading edge of the heel seat wipers 12 when in their advanced condition. For pivoting the sub-frame, a handle 30 is provided on the front thereof.

Forming part of the sub-frame 18 is a block 32 which accommodates four push-rods 34 for sliding movement in a direction transversely of the bottom of a last L carried by the last support 10, said rods being arranged side-by-side fore-and-aft of the machine. Mounted at the end, near the last support 10, of each push-rod 34 is a block 36 carrying a pivot pin 38 which extends fore-and-aft of the machine and on which two levers 40 are supported for pivotal movement. Each lever 40 supports a further pivot pin 42, extending transversely of the machine, and carrying an arm 44 which supports a lasting element 46. Each side lasting assembly 16 thus comprises eight such lasting elements. Each element 46 is carried by a pivot pin 48 mounted in the arm 44, the axis of said pin extending fore-and-aft of the machine. A spring 50 urges the lasting element downwardly about the pin 48 (counter-clockwise, when viewing FIG. 2). The lasting element 46 has a flat pressure-applying surface 52, while the end of said element facing the last support 10 is rounded at its top and bottom.

It will be appreciated that each block 36 thus carries two lasting elements 44, each independently pivotable about its own pin 42. Furthermore, it is to be noted that, when the pressure-applying surface 52 is horizontal, the axis of the pin 42 lies in the plane of said surface.

For urging each lever 40 about its pin 38, furthermore, four piston-and-cylinder arrangements 66 are provided, each acting on two associated levers 40 and each being carried by a bracket 68 carried on a mounting 70 secured to a rearward end of its associated push-rod 34. In each pair of levers 40 one is shorter than the other and there is provided, pivotally connected to the shorter lever and connected by a pin-and-slot connection to the longer lever, a link 92 itself connected by a pin-and-slot connection to a piston rod 90 of its associated piston-and-cylinder arrangement 66. In this manner, the levers 40 can be pivoted about the pin 38 independently of one another using a single piston-and-cylinder arrangement. The amount of movement in a clockwise direction of each lever is determined by a stop pin 94 carried by the bracket 68.

Mounted in the block 32, one beneath each of the push-rods 34, are four further push-rods 80. At the end, nearer the last support 10, of each push-rod 80 is secured a plate 78 on which is mounted a clamp pad in the form of a support plate 74 having an inverted L-shape to which a pad 72 of polyurethane material is adhered. The polyurethane material has a Shore A hardness of 70. Also mounted adjacent said end of each push-rod 80 is a block 96 which is connected to a piston rod 82 of a piston-and-cylinder arrangement 84, there being four such arrangements 84 each pivotally mounted on the sub-frame 18. Furthermore, each block 96 is arranged to be in engagement, in the rest condition of the machine, with a face of a depending portion of its associated block 36. Thus, when each piston-and-cylinder arrangement 84 is operated, the push-rod 80 associated therewith is moved inwardly to move the clamp rod and plate 72 and 74, inwardly towards the last support and, by engagement of the block 96 with the block 36, the wiping elements 46 associated with said pad are moved inwardly also.

At the end of the inward movement of each clamp pad and bracket 72 and 74, a locking means is actuated to lock the push-rod 80 in position, said locking means comprising an apertured plate 98 through a restricted aperture 100 of which passes the push-rod 80 (and through a larger aperture 102 of which passes the push-rod 34). Each plate 98 is pivoted at 104 on a lug of the block 32 and is urged by a spring 106 into a locking position in which the aperture 100 binds on the push-rod 80 in the manner of a bar lock. For releasing the lock, a bar 108 is mounted for pivotal movement on lugs of the block 32, said bar carrying four adjustable stop screws 110 each of which can engage with one of the plates 98. For pivoting the bar 108 a piston-and-cylinder arrangement 112 is mounted on the block 32 and acts through a link 114 connecting the piston rod 116 thereof with said bar.

Carried on a depending portion of each block 96 is a bracket 118 supporting a piston-and-cylinder arrangement 56 a piston rod 58 of which is pivotally connected to a lever 60 pivoted, intermediate its length, on a rearward end of its associated push-rod 80, and connected by a pin-and-slot connection at its other end to the mounting 70 on the rearward end of its associated push-rod 34.

The machine in accordance with the invention also comprises lasting band means comprising a plurality of bands 128, one associated with each lasting element 46, each band 128 being connected by a clamp plate 130 to an upper surface of its associated arm 44 and extending over the inwardly facing end face of its associated lasting element 46 and the inwardly facing face of its associated pad 72. Two such bands 128 extend side-by-side across said face of the pad 72. The lower end of each band is connected by springs 132 to a bracket 134 mounted on the lower end of the plate 78. The springs 132 merely serve to control the lower end of the bands but do not affect the function of the bands, to be hereinafter described.

In the operation of the machine, when in a rest condition the lasting elements, under the action of their associated cylinders 66, are in a first, raised condition in which they are spaced above the plane of the last bottom; in addition, the lasting elements 46 and the clamp pads and plates 72 and 74, are in a retracted position, as shown in FIG. 1. When a shoe to be operated upon has been placed on the last support 10, piston-and-cylinder arrangement 84 are actuated to cause the clamp pads, and thus the lasting elements 46 therewith, to be moved inwardly towards the last support until the clamp pads, independently of one another, are pressing their associated bands 128 into contact with the shoe upper. The pressure applied by the pads is in the order of 1.4 kgf/sq. cm. (20 lbs./sq. in.). In this position, piston-and-cylinder arrangement 112 is de-actuated and the bar lock is applied, the clamp pads now being locked in said position. At this stage, the lasting elements 46 are still in their first, raised, condition. Thereafter, piston-and-cylinder arrangements 56 are actuated whereupon, through their associated levers 60, the pivots of which on the push-rods 80 are now stationary, the push-rods 34, and thus the lasting elements 46 are moved inwardly relative to the clamp pads, and at the same time piston-and-cylinder arrangements 66 are actuated to cause the lasting elements 46 to be moved downwardly to a second, operative, condition in which the pressure-applying surface 52 of each element 46 can engage the shoe through its associated band 128. The inward movement of the elements 46 under the action of the cylinder 56 is limited by engagement of the forward face of the block 36 with the plate 78; the distance through which the elements 46 can move inwardly relative to the pads and plates 72 and 74 is of the order of 50 mm.

The effect of the inward and downward movement of the lasting elements 46 is to cause the bands 128 associated therewith to be drawn relative to the pads 72 heightwise of the last and about the feather line region thereof. To this end, the pressure applied by the pads is sufficient to hold the bands in pressing engagement with the upper while allowing such slippage to take place, and further the surface of each band engaging the upper is such that it can apply a frictional drafting force to the upper while the surface of the pad 72 is coated with a low-friction coating, e.g. polytetrafluoroethylene, so that the band 128 can readily slip relative thereto.

Figure 2:
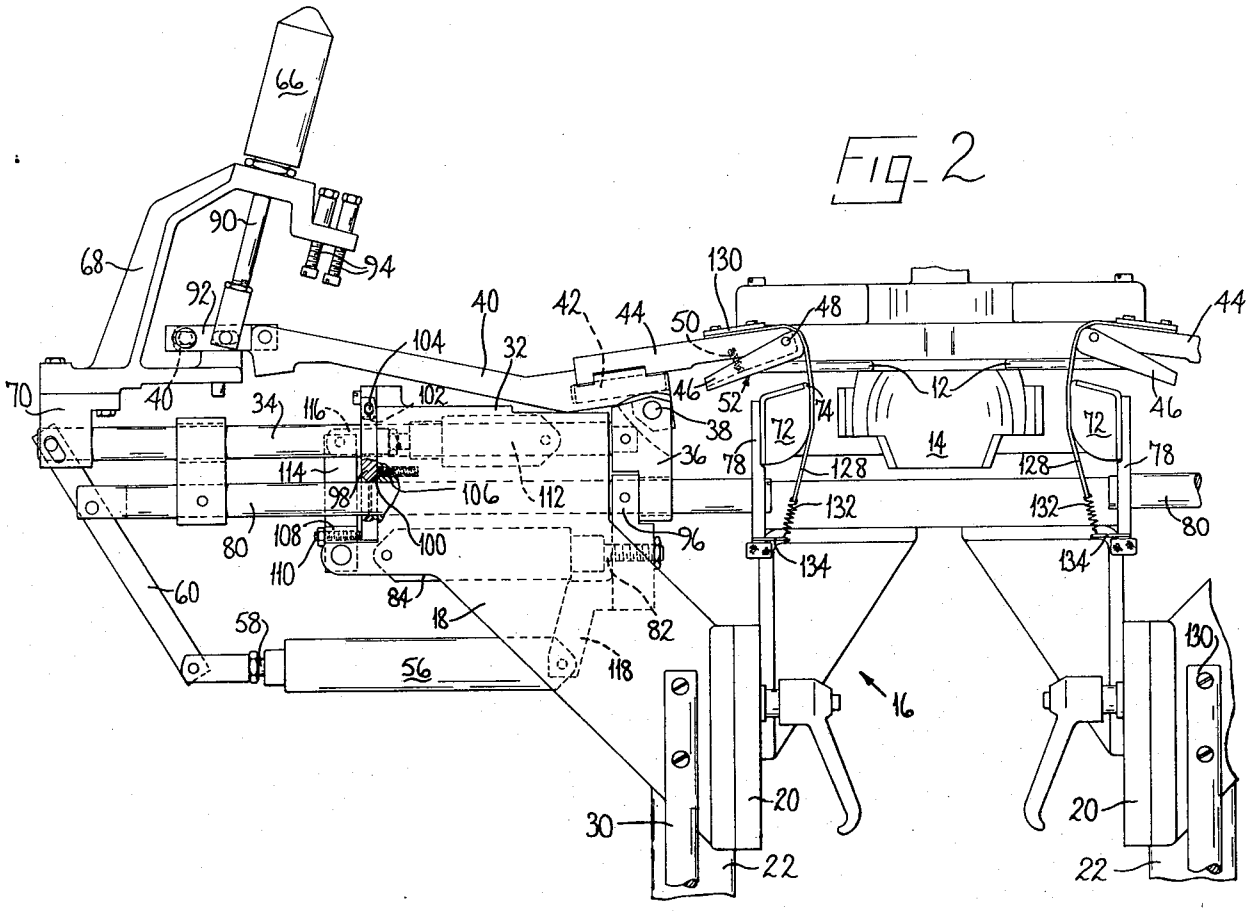
FIG. 2 is a view in front elevation, showing details of a left-hand side lasting assembly of said machine.

Also during the inward and downward movement of the lasting elements 46, because of the action of the springs 50 in urging the elements counter-clockwise as shown in FIG. 2 about the pins 48, the pressure-applying surface 52 of each element is brought into early engagement, along its length, with the feather edge of the shoe bottom, through the lasting band, and after such engagement is progressively caused to pivot, in a clockwise direction as shown in FIG. 2 about its pin 48 until it reaches its second condition in which it overlays the lasting marginal portion of the upper and serves to press them against corresponding marginal portions of the insole. This progressive action of each lasting element 46 has an "ironing" effect on the marginal portions of the upper.

It will be appreciated that the material of the lasting bands 128 should not be significantly stretchy for this function, while being relatively flexible so as to conform to the shape of the shoe being operated upon. It has been found that a suitable material may be a polyurethane having a Shore A hardness in the range 70 to 90 and a modulus not less than 850 p.s.i. at 100% elongation (as per the ASTM test procedure). Furthermore, each band may have a thickness in the range 1.5 to 3.0 mm. (1/16 to $\frac{1}{8}$ ins.).

When all the lasting elements 46 have reached their second condition, and are in pressing engagement with the shoe bottom, a bedding pressure can be applied thereby to the wiped-over lasting marginal portions of the upper, and to this end the fluid pressure control circuit of the machine is arranged so that the piston-and-cylinder arrangements 66 can be supplied with pressure fluid at two different pressures. Furthermore, when bedding pressure is applied, the piston-and-cylinder arrangement 112 of each assembly is again actuated, thereby releasing the bar lock arrangement against the action of the springs 106, whereupon the action of the piston-and-cylinder arrangements 56 is effective to cause the levers 60 to pivot about their pin-and-slot connection with the mountings 70 to cause a small withdrawal movement of the push-rods 80 away from the last support, and thus of the clamp members and plates 72 and 74, thereby discontinuing their pressing of the bands 128 against the upper. In this way, the bands 128 and clamp members and plates 72 and 74 do not interfere with the application of bedding pressure to the shoe bottom.

I claim:

1. A shoe machine for use in lasting side portions of shoe uppers comprising:

a support for a shoe last on which an upper, the side portions of which are to be lasted, and an insole are positioned; and a pair of side lasting assemblies arranged so as to act on opposite side portions of an upper positioned on a last supported by said support, wherein each side lasting assembly comprises clamping means;

said clamping means comprising at least one clamp member, movable towards the last support to cause a side portion of the upper to be held against the last, on which it is positioned and which is supported by the last support, at a locality spaced from the feather line thereof;

lasting element means, comprising a plurality of lasting elements arranged side-by-side and movable inwardly towards the last support so as to cause lasting marginal portions of the side portion of the upper to be wiped over corresponding marginal portions of the insole and be pressed thereagainst, and lasting band means comprising at least one upper-engaging band portion of flexible sheet material arranged to be interposed between the shoe upper on the one hand and the lasting elements and the clamp member(s) on the other, wherein each upper-engaging band portion is held by said clamp member(s) in the operation of the machine, against the upper positioned on its last under pressure which does not prevent movement of the upper-engaging band portion(s) relative to the clamp member(s) but which is sufficient to cause such movement of said band-engaging portion(s) to apply a drafting force to the portion of the upper engaged thereby, and inward movement of the lasting elements towards the last support as aforesaid is effective to cause movement of said band-engaging portion(s) to take place relative to the clamp member(s) whereby, in the operation of the machine, a drafting force is applied to the upper by said band engaging portion(s) heightwise of the last in the direction of the feather line of the shoe.

2. A shoe machine as recited in claim 1 wherein the upper-engaging surface of each upper-engaging band portion is such as to cause the upper to be frictionally engaged thereby, thus to apply a drafting force to the upper and wherein at least one of the opposing surfaces of each band portion and the surface of each clamp member engaging such opposite surface is a low-friction surface.

3. A shoe machine as recited in claim 2 wherein said surface of each clamp member is of polytetrafluoroethylene.

4. A shoe machine as recited in claim 2 wherein each upper-engaging band portion is made of a laminated sheet material having a first layer which comprises the upper-engaging surface and which provides sufficient friction to apply a drafting force to the upper engaged thereby, and a second layer which comprises a low-friction surface which is engaged by said clamp member(s).

5. A shoe machine as recited in claim 4 wherein the holding pressure applied by the clamp member(s) to the upper-engaging band portion(s) is of the order of 1.4 kgf/sq. cm. (20 lbs./sq. in.).

6. A shoe machine as recited in claim 4 wherein a fluid pressure operated means is provided for effecting movement of the clamp member(s) inwardly towards the last support as aforesaid, operation of said means also being effective to cause inward movement of the lasting elements therewith, and wherein locking means is provided whereby, after each clamp member has been moved to hold the band portion(s), each clamp member is locked in such position, further fluid pressure operated means then being effective to cause further inward movement of the lasting elements whereby to cause lasting marginal portions of the upper to be wiped over and pressed against corresponding marginal portions of the insole, whereby lasting marginal portions of the upper have been wiped over corresponding marginal portions of the insole under the action of said lasting element means and said locking means is caused to release the clamp member of each side lasting assembly and bedding pressure is applied through the lasting elements to such marginal portions.

7. A shoe machine as recited in claim 6 wherein a lever arrangement interconnects said clamp member(s) and said lasting elements through which arrangement said further fluid pressure operated means is effective, upon release of the locking means to cause said clamp member(s) to be withdrawn so as no longer to hold the band portion(s) against the upper during the application of bedding pressure.

8. A shoe machine as recited in claim 7 wherein each lasting element is also movable heightwise of the last support between a first condition, in which a pressure-applying surface thereof is spaced from the shoe bottom, and a second condition, in which, in the operation of the machine, said element is in pressing engagement with the shoe bottom, whereby as each element is moved towards the last support it is also moved from its first to its second condition, whereby each band portion is caused to be drawn around the feather edge of the shoe bottom, thus effecting a drafting force on the upper prior to the lasting marginal portions of the upper engaged thereby being pressed against corresponding marginal portions of the insole.

9. A shoe machine as recited in claim 8 wherein each lasting element is mounted for pivotal movement, about an axis extending lengthwise of the shoe bottom, on a mounting (forming part of the lasting element means) which is movable heightwise of the last support, such heightwise movement being effective to cause the element to be moved between its first and second conditions as aforesaid; and resilient means being provided for urging the element about said axis to a position in which a trailing portion of the pressure-applying surface thereof is inclined towards the clamp member(s), so that when inward movement of the lasting elements is effected, such trailing portions are caused to press the band portion(s) against the upper and are thereupon pivoted, against the action of the resilient means to a position in which such surface is in pressing engagement with the band portion(s).

10. A shoe machine as recited in claim 9 wherein said lasting band means of each side lasting assembly comprises a plurality of band portions one associated with each lasting element.

* * * * *